US011553792B2

(12) United States Patent
Holzapfel

(10) Patent No.: US 11,553,792 B2
(45) **Date of Patent: *Jan. 17, 2023**

(54) SYSTEM AND ASSOCIATED METHODS FOR ADVERTISING FROM A TRAFFIC SIGNAL CONTROL CABINET

(71) Applicant: On Street Media, USA, LLC, Winter Park, FL (US)

(72) Inventor: Joseph Holzapfel, Ralston, NE (US)

( * ) Notice: Subject to any disclaimer, the term of this patent is extended or adjusted under 35 U.S.C. 154(b) by 223 days.

This patent is subject to a terminal disclaimer.

(21) Appl. No.: 16/844,080

(22) Filed: Apr. 9, 2020

(65) Prior Publication Data

US 2020/0245761 A1 Aug. 6, 2020

Related U.S. Application Data

(63) Continuation of application No. 15/892,496, filed on Feb. 9, 2018, now Pat. No. 10,646,036, which is a continuation of application No. 14/974,543, filed on Dec. 18, 2015, now Pat. No. 9,918,549.

(60) Provisional application No. 62/093,456, filed on Dec. 18, 2014.

(51) Int. Cl.

| | |
|---|---|
| ***G09F 7/00*** | (2006.01) |
| ***A47B 81/00*** | (2006.01) |
| ***G09F 13/04*** | (2006.01) |
| ***G09F 7/18*** | (2006.01) |
| ***F21V 33/00*** | (2006.01) |

(52) U.S. Cl.

CPC ..... *A47B 81/00* (2013.01); *F21V 33/0012* (2013.01); *G09F 7/18* (2013.01); *G09F 13/0413* (2013.01); *G09F 13/0445* (2021.05); *G09F 2007/1843* (2013.01)

(58) Field of Classification Search

CPC .... G09F 7/18; G09F 13/0413; G09F 13/0445; G09F 2007/1843

See application file for complete search history.

(56) References Cited

U.S. PATENT DOCUMENTS

| | | | | |
|---|---|---|---|---|
| 3,521,937 | A | 7/1970 | Buhrmaster et al. | |
| 3,793,756 | A | 2/1974 | Kay et al. | |
| 3,803,738 | A | 4/1974 | Weiss | |
| 3,866,824 | A | 2/1975 | Lewis | |
| 4,300,299 | A | 11/1981 | Batky et al. | |
| 4,639,725 | A * | 1/1987 | Franke | G09B 19/06 40/573 |
| 5,496,081 | A | 3/1996 | Rice | |
| 5,605,364 | A | 2/1997 | Shelledy | |
| 5,622,397 | A | 4/1997 | Rice et al. | |
| 5,729,924 | A | 3/1998 | Reading | |
| 5,826,923 | A | 10/1998 | Bethurem | |
| 6,092,319 | A | 7/2000 | Hicks | |
| 7,096,625 | B1 | 8/2006 | Hering | |
| 7,661,733 | B1 | 2/2010 | Angel | |
| 9,918,549 | B1 * | 3/2018 | Holzapfel | F21V 33/0012 |

(Continued)

*Primary Examiner* — Y M. Quach Lee

(74) *Attorney, Agent, or Firm* — Greenberg Traurig, P.A.; Stephen G. Anderson

(57) ABSTRACT

An advertising medium includes a frame enclosing a traffic signal control cabinet. Tie rods extend between lock devices, which are secured to rails of the frame such that removing the frame from its position around the cabinet is prevented. As a result, advertising material may be secured to a traffic signal control cabinet without intruding upon or modifying the cabinet.

12 Claims, 9 Drawing Sheets

(56) References Cited

U.S. PATENT DOCUMENTS

| | | | | |
|---|---|---|---|---|
| 10,646,036 | B2 * | 5/2020 | Holzapfel | G09F 13/0413 |
| 2001/0035701 | A1 | 11/2001 | Holzheid | |
| 2007/0158957 | A1 | 7/2007 | Kramer et al. | |
| 2007/0205703 | A1 | 9/2007 | McLuckie et al. | |
| 2011/0203335 | A1 | 8/2011 | DeWalch et al. | |
| 2014/0080406 | A1 | 3/2014 | Freitas et al. | |
| 2014/0361551 | A1 | 12/2014 | Rickman | |
| 2015/0047240 | A1 | 2/2015 | Pyc et al. | |
| 2015/0191949 | A1 | 7/2015 | Wilson | |
| 2015/0300628 | A1 | 10/2015 | Dunn et al. | |
| 2016/0314724 | A1 | 10/2016 | Benasillo | |
| 2017/0190509 | A1 | 7/2017 | Reeb et al. | |
| 2017/0352301 | A1 | 12/2017 | Holzapfel | |

* cited by examiner

SYSTEM AND ASSOCIATED METHODS FOR ADVERTISING FROM A TRAFFIC SIGNAL CONTROL CABINET

CROSS REFERENCE TO RELATED APPLICATIONS

This application is a continuation of, claims the benefit of, and claims priority to, U.S. patent application Ser. No. 15/892,496, filed Feb. 9, 2018, which is a continuation of, claims the benefit of, and claims priority to U.S. patent application Ser. No. 14/974,543, filed Dec. 18, 2015, which itself claims priority to U.S. Provisional Patent Application Ser. No. 62/093,456, filed Dec. 18, 2014, the contents of which are incorporated by reference and commonly owned.

FIELD OF THE INVENTION

The present invention generally relates to advertising display devices and in particular to an advertising system mountable on a cabinet structure without jeopardizing integrity of the cabinet structure.

BACKGROUND

Advertising media take on a variety of forms as do the devices designed to secure the advertising media to a structural support while allowing clear public view. Examples of such devices are included in U.S. Pat. No. 7,096,625 to Hering for "A Method of Displaying Advertising on a Turnstile" and U.S. Pat. No. 6,092,319 to Hicks for an "Apparatus for Connecting Advertising Substrate to Trucks." Yet further and as disclosed in US Application Publication US 2001/0035701 to Holzheid for "Framing for Public Space Housings to Hold and to Facilitate Display of Visual Materials," outdoor cabinets such as traffic control boxes provide potential sites for advertising and provide a source of advertising revenue.

As disclosed in Holzheid, equipment must be protected from the elements as well as vandalism or other destruction by humans. In many cases, the equipment is protected by a housing for traffic signal control boxes are especially susceptible to vandalism. Traffic signal control boxes are generally vertical structures positioned at street intersections for the purpose of housing the electronics needed to control traffic signals at the intersections. For example, while traffic control cabinets generally located at each intersection having traffic lights have blank space on side walls, municipalities frown on "bumper sticker" styled signs stuck to the side walls and such signs are difficult to remove. The present invention is directed to providing an advertising option for advertising from such traffic control cabinets without the need for intrusion into the cabinet walls surfaces and with ease in replacing advertising indicia. Yet further, while outer coverings for such housings may be known, there remains a need to attach such covers and thus possible advertising media to the housings without intruding or modifying the housing.

SUMMARY

Embodiments of the present invention are herein described by way of example and directed to advertising display methods and devices mountable on a cabinet structure without jeopardy to the integrity of the cabinet.

By way of example in satisfying a need, embodiments of the invention permit signage, such as advertising, to be placed on a traffic signal control cabinet, or the like, without scratching, marring, or discoloring the original surface of the cabinet, and further without being invasive in any way to the cabinet or its function. Further, the signage may be carried by the cabinet without interfering with the cabinet access door. Embodiments of the invention permit a frictional attachment of the signage while withstanding relatively high winds and severe weather without damage to the signage. Signage may be attached to any or all sides of the cabinet while having the attaching means inaccessible to the general public.

One embodiment provides an advertising medium which may comprise a frame enclosing a traffic signal control cabinet. The frame may include opposing rails for each side of the cabinet with opposing inside surfaces of the rails including grooves extending longitudinally along the rail and spaced from each other. A light panel may be carried within one groove near, yet spaced from, surfaces of cabinet walls. An advertising panel may be carried within a second groove. The advertising panel is spaced from the light panel and on an opposite side from the cabinet wall. A clear protective panel may be carried within a third groove and opposite an outer surface of the advertising panel. Tie rods may extend between lock devices which are secured to the rails such that removing the frame from its position around the cabinet is prevented. As a result, advertising material may be secured to the traffic signal control cabinet without intruding or modifying the cabinet.

BRIEF DESCRIPTION OF DRAWINGS

For a fuller understanding of the invention, reference is made to the following detailed description, taken in connection with the accompanying drawings in which.

DETAILED DESCRIPTION OF EMBODIMENTS

The teachings of the present invention will now be described more fully hereinafter with reference to the accompanying drawings, in which embodiments of the invention are shown by way of illustration and non-limiting example. This invention may be embodied in many forms and should not be construed as limited to the embodiments set forth herein. Rather, these embodiments are provided so that this disclosure will be thorough and complete, and will fully convey the scope of the invention to those skilled in the art.

Figure 1:
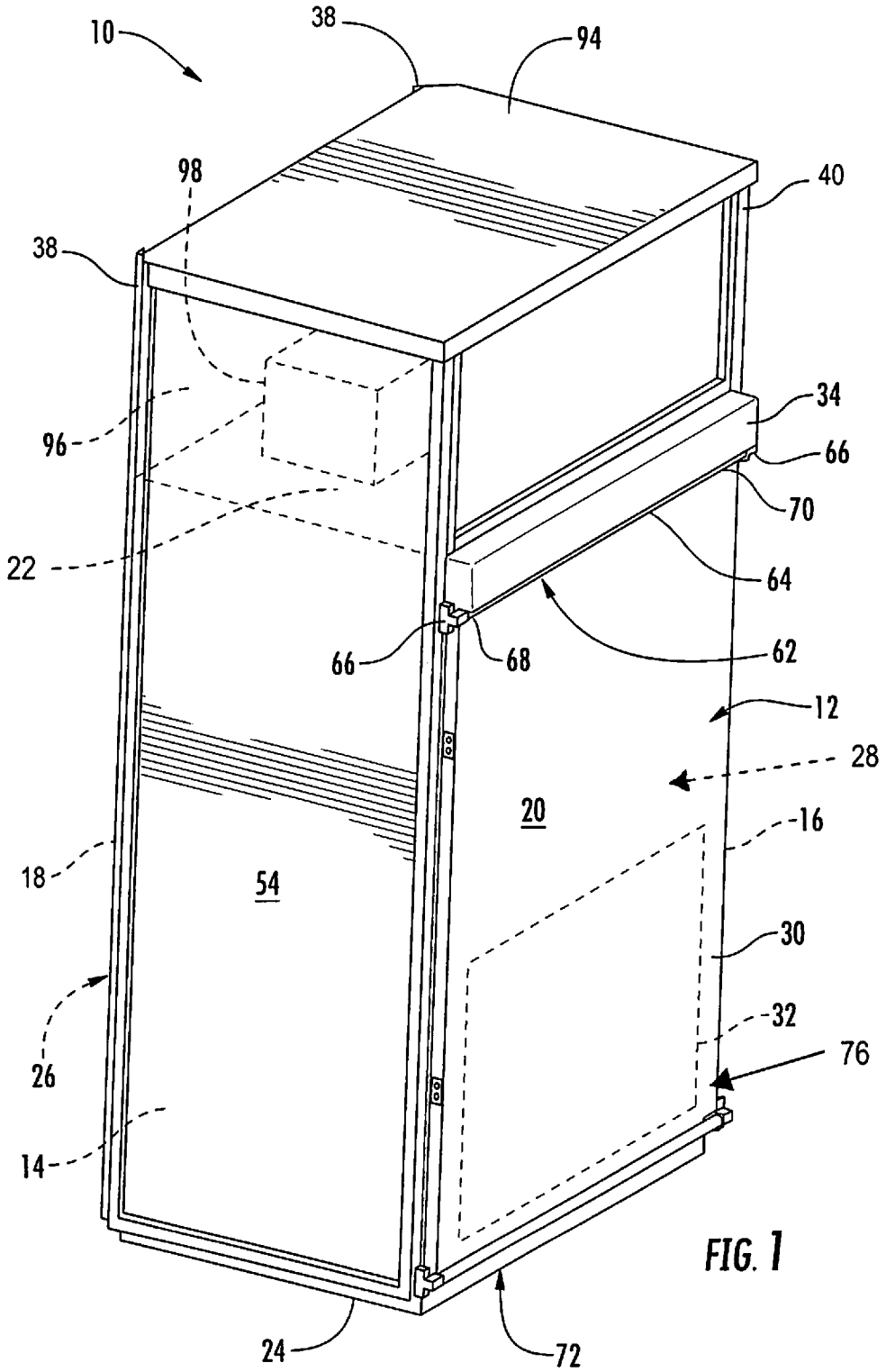
FIG. 1 is a perspective view of one embodiment of the present invention including an advertising medium secured to a traffic signal control cabinet.

With reference initially to FIG. 1, one embodiment of the invention is herein described as an advertising medium 10 employing a traffic signal control cabinet 12. As generally described, the cabinet 12 comprises a first planar side wall 14 spaced from a second planar side wall 16, with a planar front wall 18 and rear wall 20 extending therebetween. Top and bottom walls 22, 24 add to a rectangular shaped housing 26 having an enclosed storage area 28 formed therein. The cabinet 12 further comprises a door 30 extending over an opening 32 formed in the rear wall 20, by way of non-limiting example, and wherein the top wall 22 extends beyond at least the rear wall 20 to form a flange 34 above the door 30.

As illustrated with reference to FIG. 2, a frame 36 generally encloses the cabinet 12. The frame 36 has opposing rails 38, 40 for each of the side 14, 16, rear 20 and front 18 walls of the cabinet 12. Opposing inside surfaces 42, 44 of the rails 38, 40 include a plurality of grooves 46 extending longitudinally along the rail and spaced from each other, as illustrated with reference to FIG. 3.

Figure 3:
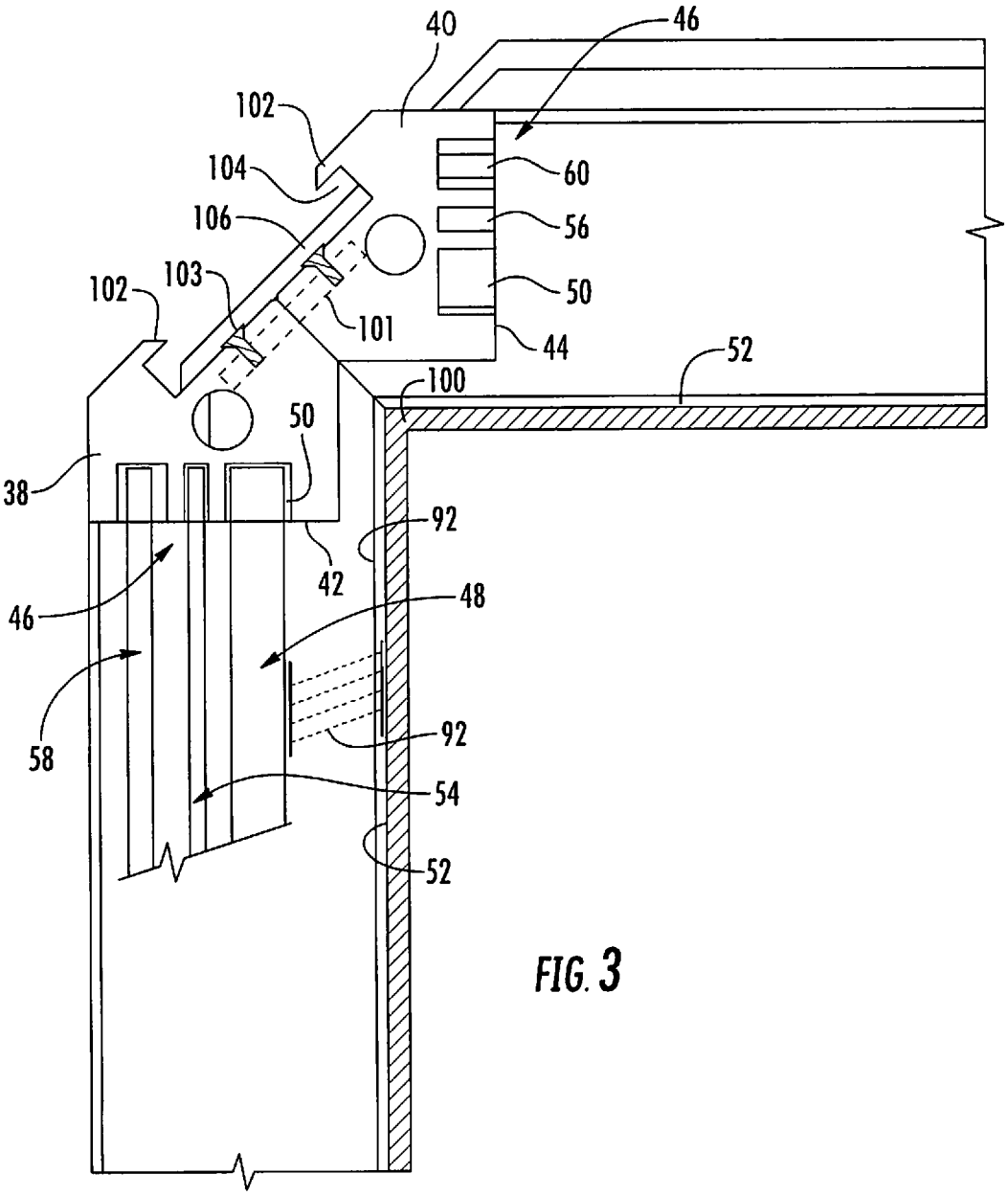
FIG. 3 is a partial cross sectional view illustrating rail portions of the frame of the embodiment of FIG. 1 and use thereof.

As further illustrated with reference to FIG. 3, a light panel 48 is carried within a first groove 50 and spaced from surfaces 52 of the respective walls. An advertising panel 54 is carried within a second groove 56 and spaced from the light panel 48 at a further distance from the cabinet wall surface 52 than the light panel 48. A clear protective panel 58 is carried within a third groove 60 and itself spaced from the advertising panel 54 and further distanced from the cabinet wall surface 52 than the advertising panel 54.

Figure 4:
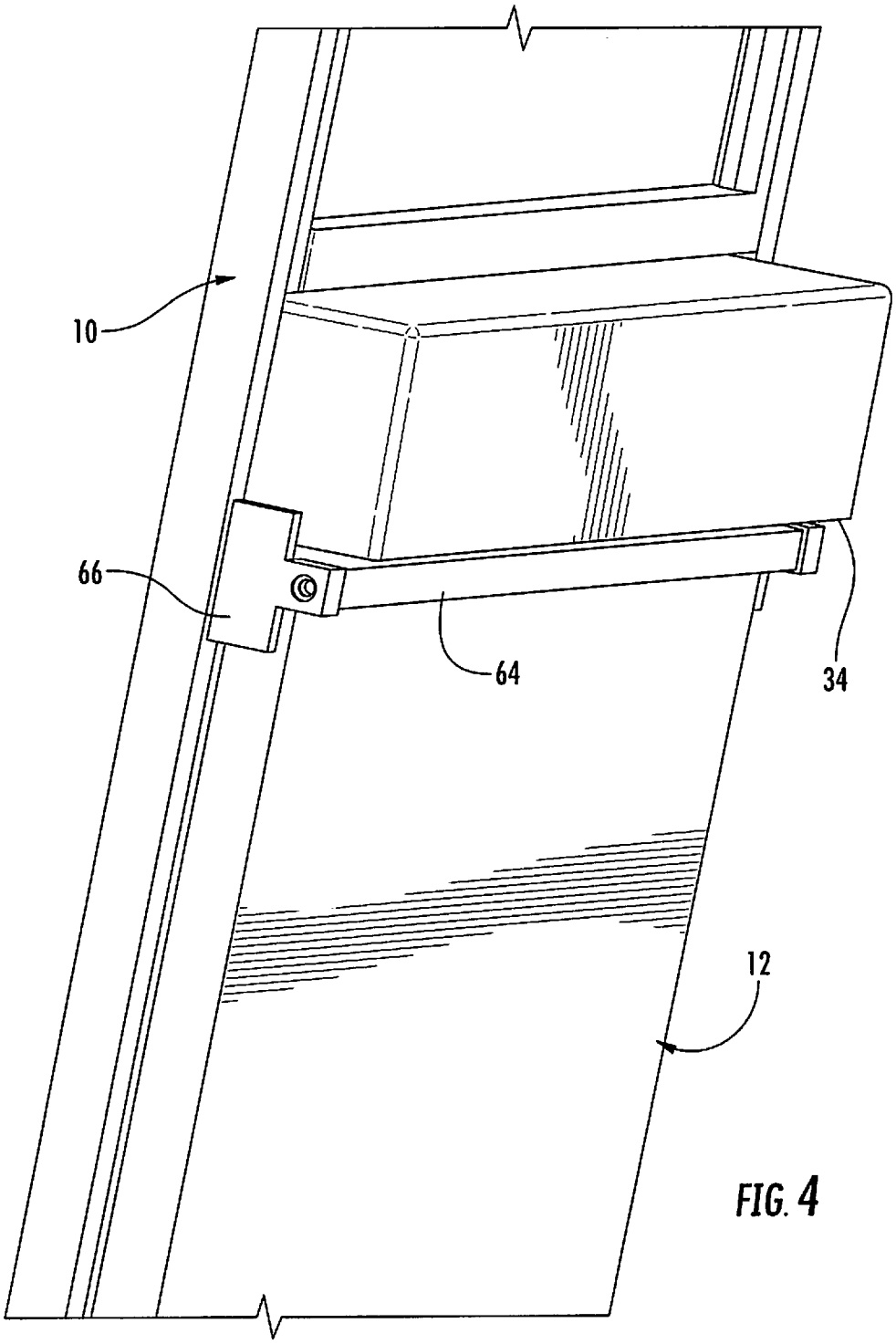
FIG. 4 is a partial perspective view of the embodiment of FIG. 1 illustrating a locking assembly portion according to the teachings of the present invention.
Figure 5:
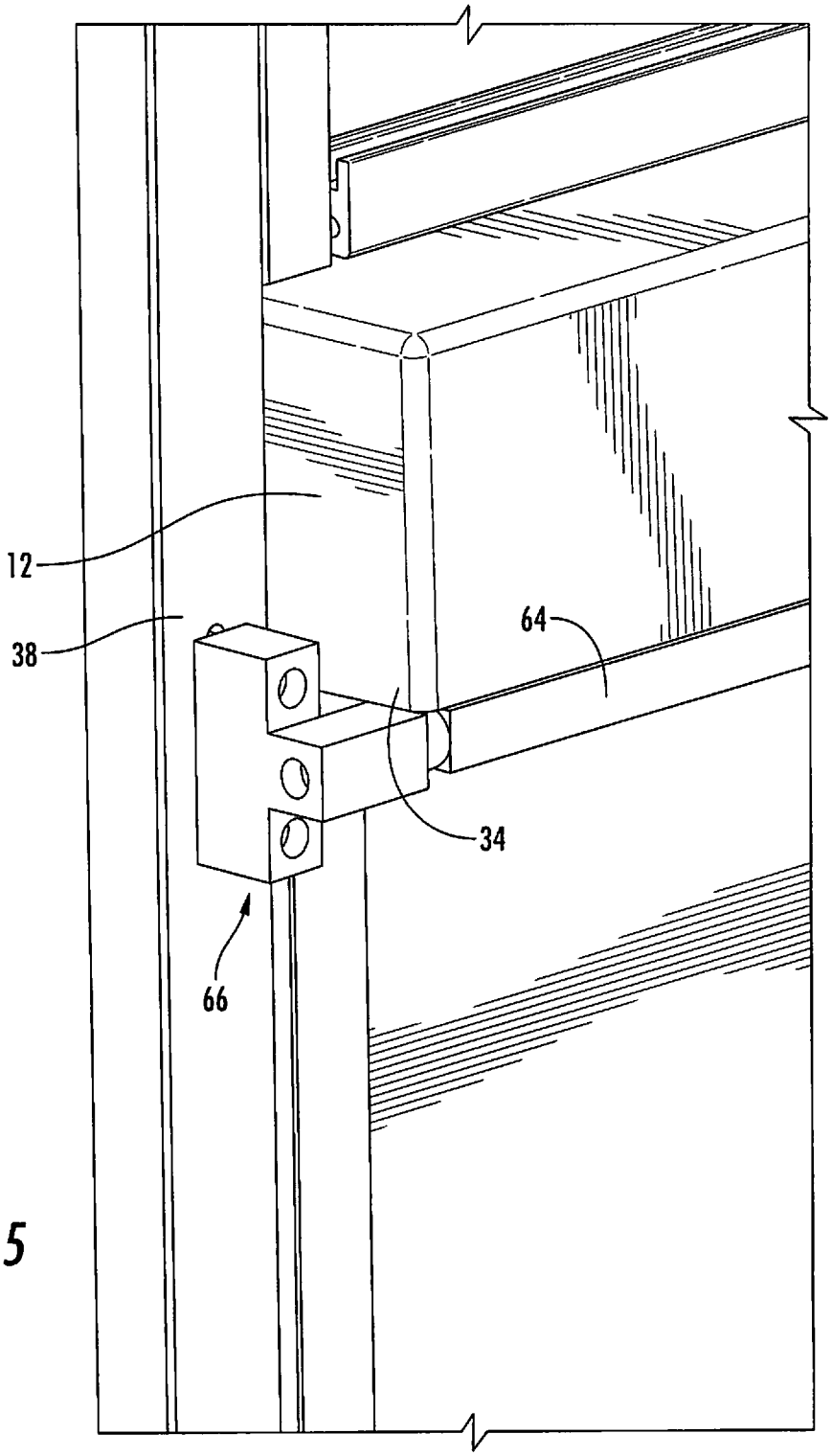
FIG. 5 is a closer perspective view of the embodiment illustrated in FIG. 4 further illustrating a lock device used therewith.

As illustrated with reference again to FIGS. 1 and 2, and now to FIGS. 4 and 5, a first locking assembly 62 includes a first tie rod 64 extending between opposing rails 38, 40 proximate the rear wall 20 and under the flange 34. A lock device 66 is affixed to free ends 68, 70 of the first tie rod 64. The lock device 66 is secured to the opposing rails 38, 40 proximate the rear wall 20 and under the flange 34 such that a vertical lifting of the frame 36 is limited by interaction of the first tie rod 64 with the flange.

Figure 2:
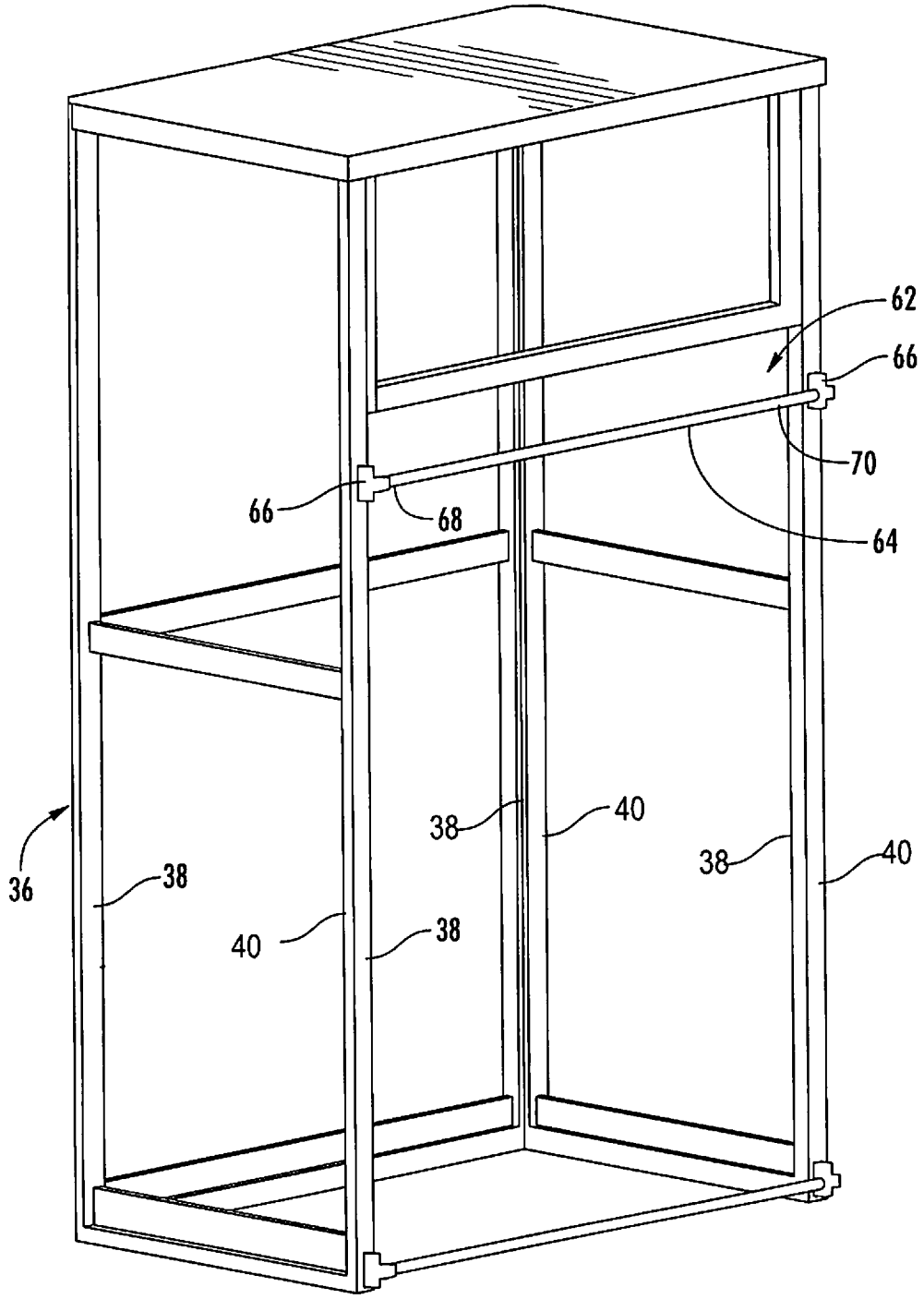
FIG. 2 is a perspective view of a frame assembly of the embodiment of FIG. 1 illustrating selected elements thereof, by way of non-limiting example.
Figure 6:
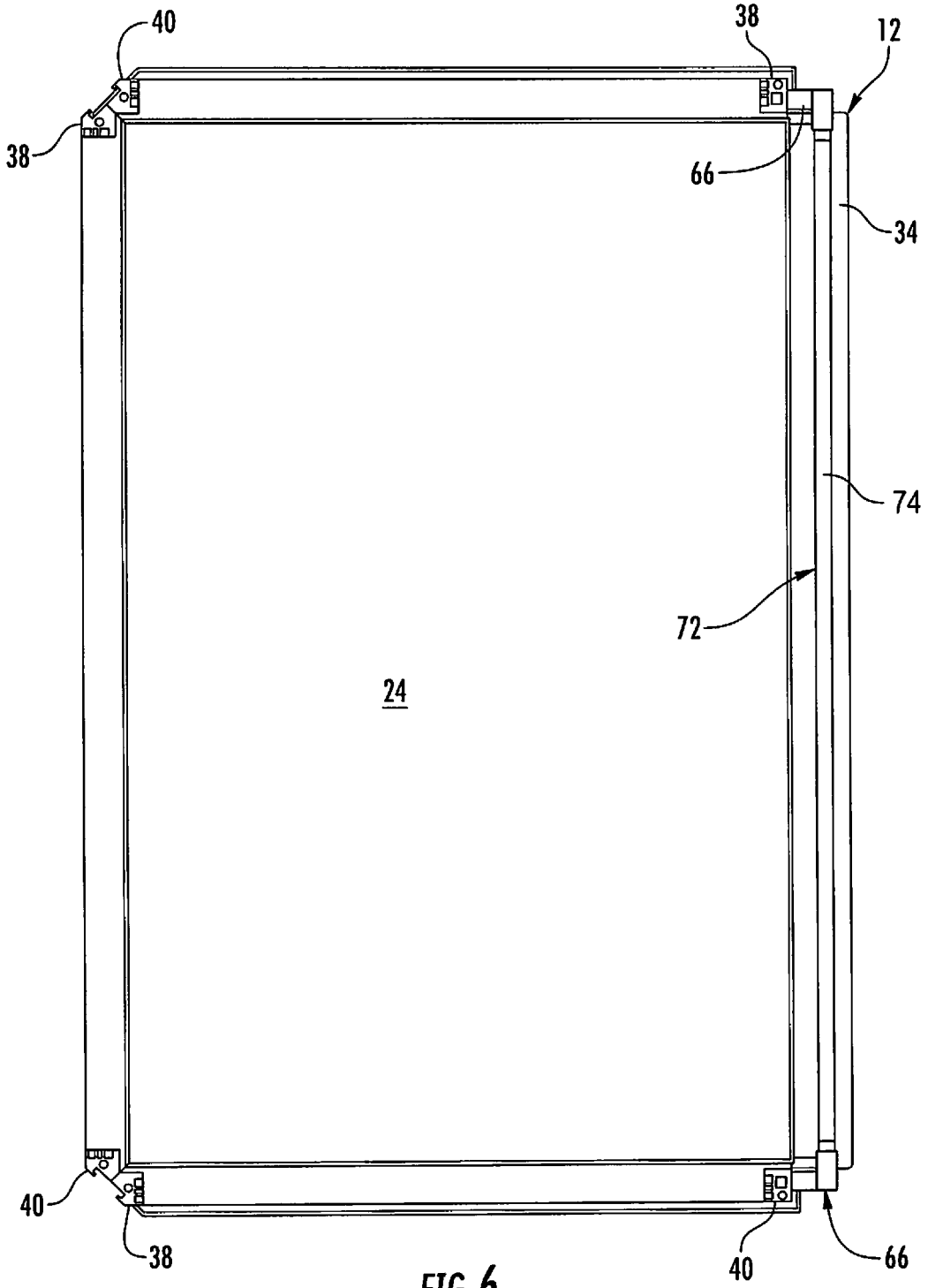
FIG. 6 is a bottom view of the embodiment of FIG. 1.

With continued reference to FIGS. 1 and 2 and to FIG. 6, a second locking assembly 72 includes a second tie rod 74 extending between the opposing rails 38, 40 proximate the rear wall 20 and at a lower portion 76 of the rear wall 20 sufficient for permitting access into the cabinet housing 26 through the opening 32 when the door 30 is in an opened position. The lock device 66, as above described, is affixed to each of opposing ends of the second tie rod 74 with the lock device secured to the opposing rails 38, 40 with the second tie rod 74 held proximate the rear wall 20.

As illustrated with reference to FIG. 7, one embodiment of the lock device 66, herein described by way of example, comprises a body 78 having a first leg 80 including a first bore 82 extending longitudinally therein. The first bore 82 receives the free end 68, 70 of the tie rods 64, 74, wherein a first bolt 84 extends into the first bore 82 to secure the tie rod to the body 78. A second leg 86 extends generally perpendicular to the first leg 80. The second leg 86 includes a second bore 88, herein two second bores illustrated by way of example, extending through the second leg. A second bolt 90 extends through the second bore 88 into the rail 38, 40 and secures the body 78 to the rail, thus securing the lock device 66 to the rails.

Figure 7:
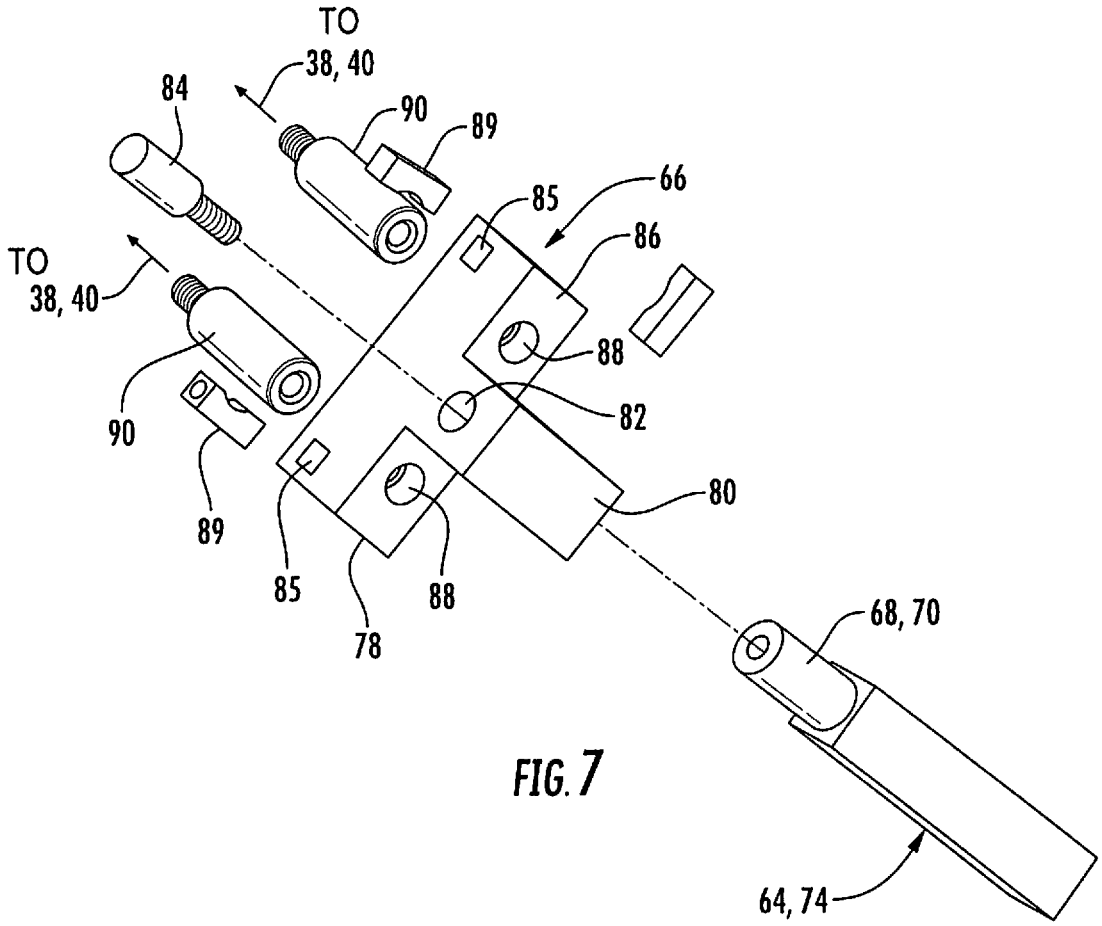
FIG. 7 is an exploded perspective view of the lock device of FIG. 5.

With continued reference to FIG. 7, the second leg 86 includes a third bore 85 extending therein proximate the second bore 88 and generally perpendicular to an axis thereof, the lock device 66 including a key 89 extending into the third bore 85 mating with the second bolt 90 for fixing the second bolt within the second bore and preventing movement thereof.

With reference again to FIG. 3, a foam pad or sheet 92 may be sandwiched between at least some of the side wall surfaces 52 of the cabinet housing 26 and respective light panels 48. The foam pads may optionally have a thickness for sufficiently preventing damage to the wall surfaces 52 and sufficiently thick to contact both the wall surface 52 and the light panel 48, as desired.

With reference again to FIGS. 1 and 2, a top cover panel 94 is secured to the plurality of rails 38, 40 thus contributing to the forming of the frame 36, wherein the rails, and thus the frame extends beyond the top wall 22 of the cabinet 12 for providing a utility storage area 96 between at least a portion of the top wall of the cabinet and the top cover panel. Electronic and other equipment, such as batteries, may be securely stored within the utility storage area 96.

With reference again to FIG. 3, adjacent rails 38, 40 of the frame 36 located at corners 100 of the cabinet 12 are secured together, using bands 101 and screws 103, by way of example. The mirror image shape of each rail 38, 40 is such that tabs 102 on each rail combine to form a slot 104 longitudinally extending along the adjacent rails 38, 40, by way of example. A ribbon cover 106 extends in the slot and limits access to the screws 103, by way of further example.

Figure 8:
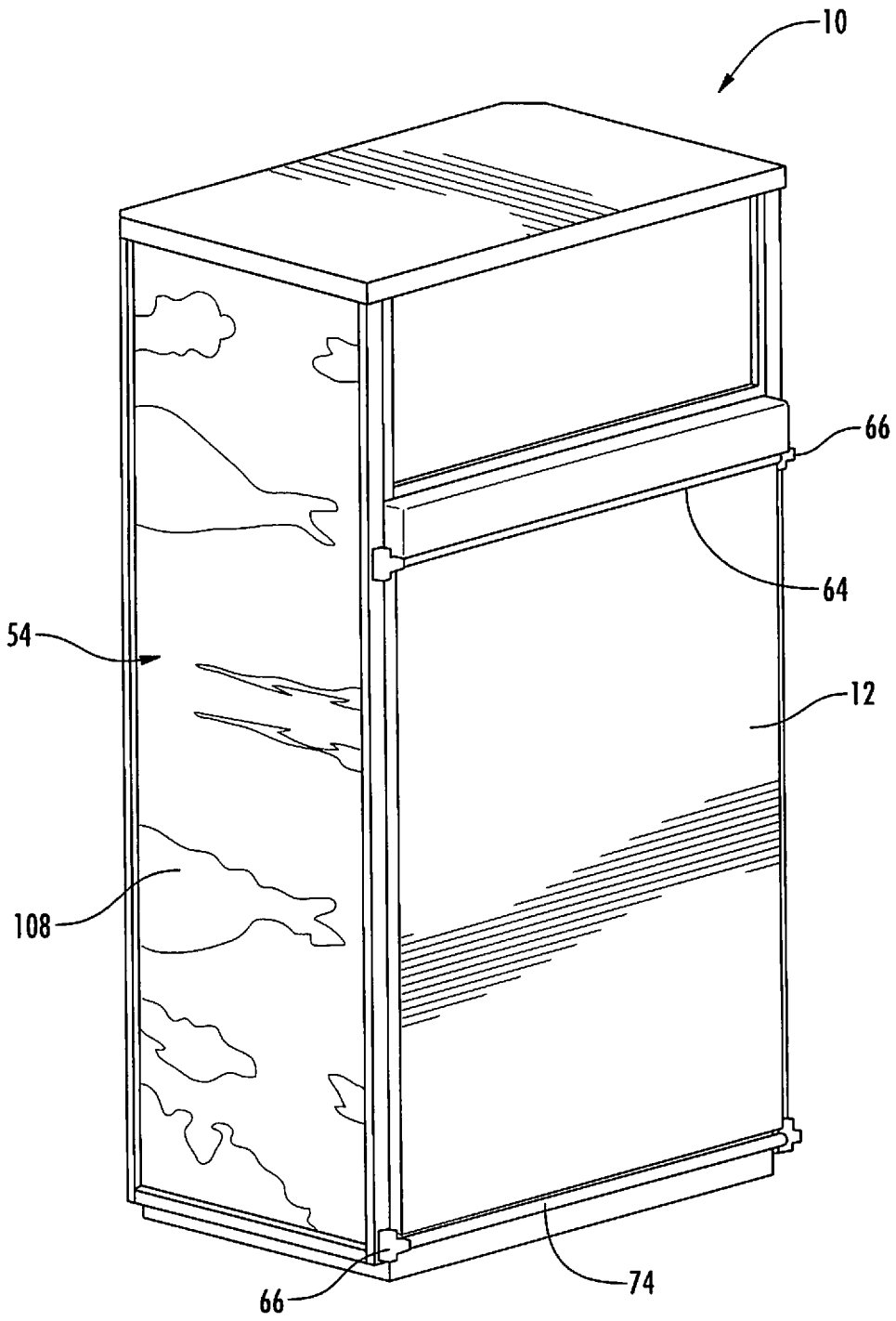
FIG. 8 is a front left perspective view of the embodiment of the present invention, herein described by way of example only, illustrating advertising medium displayed from the traffic signal control cabinet.
Figure 9:
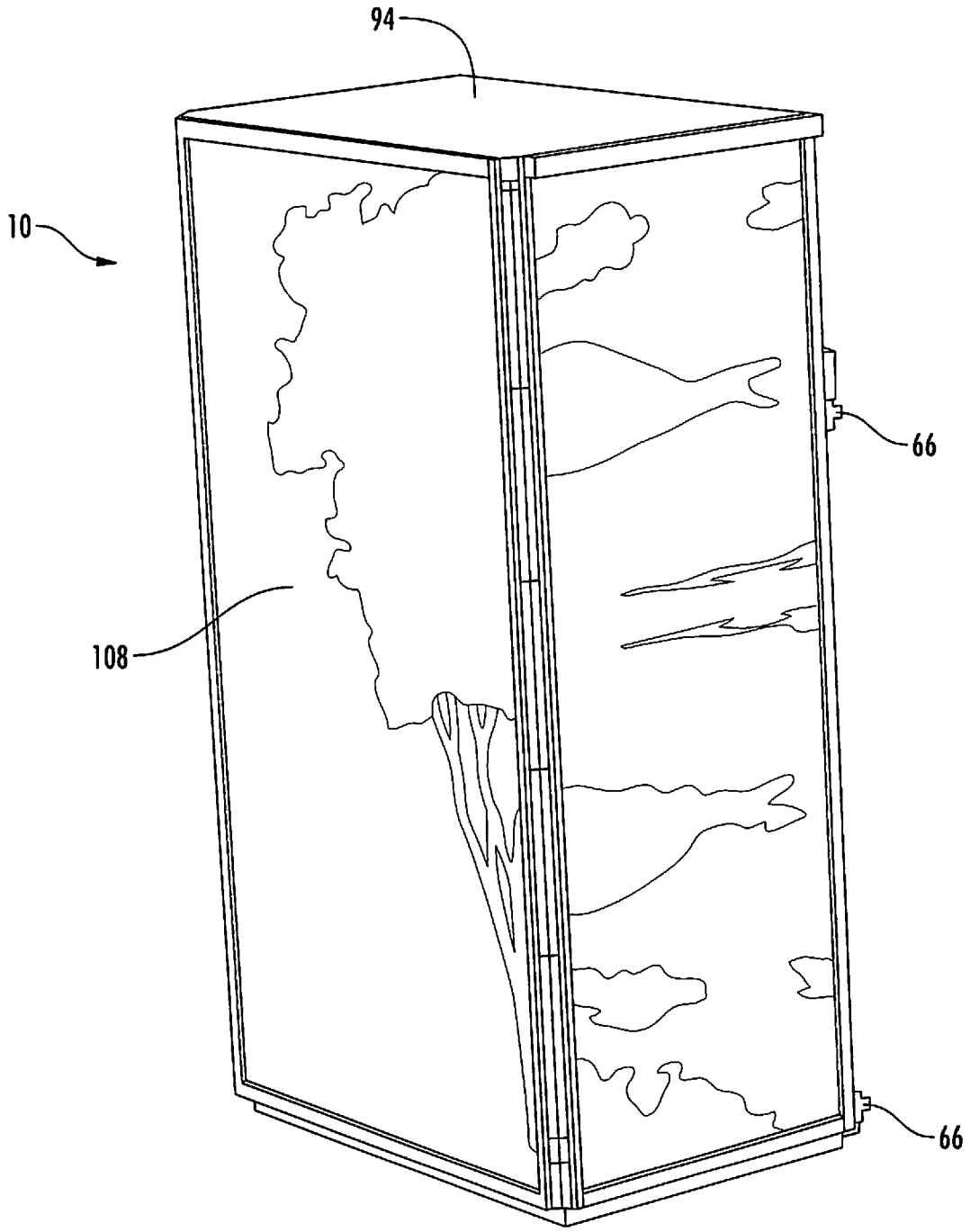
FIG. 9 is a rear right perspective view of the embodiment of FIG. 8.

As illustrated with reference to FIGS. 8 and 9, it will come to the mind of those skilled in the art that commercial and environmental promotions indicia/images 108 may be attractively displayed from what is typically a bland box. Such use can further benefit the government entities responsible for traffic signal control cabinets by providing desired revenue while maintaining the integrity of the traffic signal control.

It is to be understood that the invention is not to be limited to the specific embodiments disclosed, and that modifications and alternate embodiments are intended to be included within the scope of the claims supported by this specification.

What is claimed is:

1. A frame for securing an advertisement, to a cabinet, the cabinet having a flange extending therefrom, the frame comprising:

a pairs of rails; and a tie rod extending between the rails, the tie rod positioned for restricting movement of the frame by interaction with the flange.

2. The frame of claim 1, further comprising a first locking mechanism configured for securing a first end of the tie rod to one of the rails.

3. The frame of claim 2, further comprising a second locking mechanism configured for securing a second end of the tie rod to one of the rails.

4. The frame of claim 1, wherein opposing inside surfaces of each of the rails include at least one groove extending longitudinally along the rail.

5. The frame of claim 4, further comprising a panel carried within a groove, the panel held in spaced relation a surface of a respective cabinet wall.

6. The frame of claim 5, further comprising an advertising panel carried within a second groove.

7. The frame of claim 1, further comprising a second tie rod extending between the rails.

8. The frame of claim 7, further comprising a first locking mechanism configured for securing a first end of the second tie rod to one of the rails.

9. The frame of claim 8, further comprising a second locking mechanism configured for securing a second end of the second tie rod to one of the rails.

10. The frame of claim 7, wherein opposing inside surfaces of each of the rails include at least one groove extending longitudinally along the rail.

11. The frame of claim 10, further comprising a panel carried within a groove, the panel held in spaced relation to a surface of a respective cabinet wall.

12. The frame of claim 11, further comprising an advertising panel carried within a second groove.

* * * * *